US010079085B2

(12) United States Patent
Li et al.

(10) Patent No.: US 10,079,085 B2
(45) Date of Patent: Sep. 18, 2018

(54) RARE-EARTH PERMANENT MAGNETIC POWDER, BONDED MAGNET CONTAINING THEREOF AND DEVICE USING THE BONDED MAGNET

(71) Applicants: Hongwei Li, Beijing (CN); Yang Luo, Beijing (CN); Dunbo Yu, Beijing (CN); Kuoshe Li, Beijing (CN); Wenlong Yan, Beijing (CN); Shipeng Li, Beijing (CN); Yongqiang Yuan, Beijing (CN); Haijun Peng, Beijing (CN)

(72) Inventors: Hongwei Li, Beijing (CN); Yang Luo, Beijing (CN); Dunbo Yu, Beijing (CN); Kuoshe Li, Beijing (CN); Wenlong Yan, Beijing (CN); Shipeng Li, Beijing (CN); Yongqiang Yuan, Beijing (CN); Haijun Peng, Beijing (CN)

(73) Assignees: GENERAL RESEARCH INSTITUTE FOR NONFERROUS METALS, Beijing (CN); GRIREM ADVANCED MATERIALS CO., LTD., Beijing (CN)

( * ) Notice: Subject to any disclaimer, the term of this patent is extended or adjusted under 35 U.S.C. 154(b) by 402 days.

(21) Appl. No.: 14/651,560

(22) PCT Filed: May 31, 2013

(86) PCT No.: PCT/CN2013/076605

§ 371 (c)(1),
(2) Date: Jun. 11, 2015

(87) PCT Pub. No.: WO2014/190558

PCT Pub. Date: Dec. 4, 2014

(65) Prior Publication Data

US 2015/0318089 A1 Nov. 5, 2015

(51) Int. Cl.

| | |
|---|---|
| ***B22F 1/00*** | (2006.01) |
| ***B22F 9/00*** | (2006.01) |
| ***H01F 1/059*** | (2006.01) |
| ***C22C 38/00*** | (2006.01) |
| ***H01F 1/08*** | (2006.01) |
| ***H01F 1/22*** | (2006.01) |
| ***H01F 41/02*** | (2006.01) |
| ***C21D 6/00*** | (2006.01) |
| ***C21D 1/18*** | (2006.01) |
| ***C22C 38/10*** | (2006.01) |
| ***C22C 38/14*** | (2006.01) |
| ***C22C 38/12*** | (2006.01) |
| ***C22C 38/06*** | (2006.01) |
| ***C22C 38/02*** | (2006.01) |
| ***B22F 9/08*** | (2006.01) |
| ***C23C 8/22*** | (2006.01) |
| ***C23C 8/26*** | (2006.01) |
| ***H01F 1/055*** | (2006.01) |
| ***C22C 38/04*** | (2006.01) |

(52) U.S. Cl.

CPC ..... *H01F 1/059* (2013.01); *B22F 1/00* (2013.01); *B22F 9/082* (2013.01); *C21D 1/18* (2013.01); *C21D 6/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/10* (2013.01); *C22C 38/12* (2013.01); *C22C 38/14* (2013.01); *C23C 8/22* (2013.01); *C23C 8/26* (2013.01); *H01F 1/0551* (2013.01); *H01F 1/0558* (2013.01); *H01F 1/083* (2013.01); *H01F 1/22* (2013.01); *H01F 41/0266* (2013.01)

(58) Field of Classification Search

None

See application file for complete search history.

(56) References Cited

U.S. PATENT DOCUMENTS 4,496,395 A * 1/1985 Croat ..... C22C 45/00 148/301
4,802,931 A * 2/1989 Croat ..... H01F 1/057 148/302
5,716,462 A 2/1998 Sakurada et al.
(Continued)

FOREIGN PATENT DOCUMENTS

CN 101552060 A 10/2009
CN 101572143 A 11/2009
(Continued)

OTHER PUBLICATIONS

International Search Report for Application No. PCT/CN 2013/076605 dated Mar. 13, 2014.
IPRP with Written Opinion for Application No. PCT/CN 2013/076605 dated Dec. 1, 2015.
Korean Office Action for Korean Application No. 10-2015-7017182 dated Jun. 20, 2016.
(Continued)

*Primary Examiner* — Devang R Patel
(74) *Attorney, Agent, or Firm* — Jenkins, Wilson, Taylor & Hunt, P.A.

(57) ABSTRACT

A rare-earth permanent magnetic powder, a bonded magnet containing thereof and a device using the bonded magnet are provided of the present disclosure. The rare-earth permanent magnetic powder comprises: 70 vol % to 99 vol % of a hard magnetic phase and 1 vol % to 30 vol % of a soft magnetic phase, the hard magnetic phase has a $TbCu_7$ structure, and the grain size of the hard magnetic phase is 5 nm to 100 nm; the soft magnetic phase is a Fe phase having a bcc structure, the average grain size of the soft magnetic phase is 1 nm to 30 nm, and the standard deviation of the grain size is below 0.5σ.

14 Claims, No Drawings

(56) References Cited

U.S. PATENT DOCUMENTS

| | | | | |
|---|---|---|---|---|
| 5,750,044 | A | 5/1998 | Yoneyama et al. | |
| 5,916,376 | A * | 6/1999 | Fukuno | H01F 1/059 148/101 |
| 7,022,252 | B2 * | 4/2006 | Mochizuki | H01F 1/0571 148/101 |
| 7,087,185 | B2 * | 8/2006 | Arai | B82Y 25/00 148/302 |
| 7,316,752 | B2 * | 1/2008 | Tomizawa | H01F 41/0266 148/101 |
| 2005/0098239 | A1 * | 5/2005 | Kuniyoshi | C22C 38/002 148/302 |

FOREIGN PATENT DOCUMENTS

| | | | |
|---|---|---|---|
| JP | H07-173501 | A | 7/1995 |
| JP | H08-316018 | A | 11/1996 |
| JP | H11-3812 | A | 1/1999 |
| JP | 2001-135509 | A | 5/2001 |
| JP | 2001-167915 | A | 6/2001 |
| JP | 2004-111481 | A | 4/2004 |
| JP | 2008-264875 | A | 11/2008 |
| JP | 2016-515594 | A | 5/2016 |

OTHER PUBLICATIONS

Korean Office Action for Korean Application No. 10-2015-7017182 dated Oct. 31,2016.

* cited by examiner

RARE-EARTH PERMANENT MAGNETIC POWDER, BONDED MAGNET CONTAINING THEREOF AND DEVICE USING THE BONDED MAGNET

TECHNICAL FIELD

The present disclosure relates to a rare-earth magnetic material, particularly to a rare-earth permanent magnetic powder, a bonded magnet containing the rare-earth permanent magnetic powder and a device using the bonded magnet.

BACKGROUND

A bonded rare-earth permanent magnet is formed by combining a rare-earth permanent magnetic powder with a bonding material and is directly shaped into various permanent magnet devices through injection molding or compression molding according to the requirement of the user. The magnet has advantages of high dimensional accuracy, excellent magnetic uniformity, high corrosion resistance, high yield, and be easily shaped into a complicated device and so on, and it has been widely applied to household appliances, micro-machines, automatic office equipment, instruments and meters, medical devices, automobiles, magnetic machines and other apparatuses and devices.

Currently, bonded rare-earth permanent magnet powder mainly includes NdFeB magnetic powder and nitride rare-earth magnetic powder. In recent years, with the development of electric motor cars, wind power generation and magnetically levitated trains, a higher requirement is put forward to high-performance and high-stability rare-earth permanent magnets. For nitride rare-earth magnetic powder has high magnetic performance and excellent corrosion resistance, it has been used increasingly widely, thus, how to improve the performance of the nitride rare-earth magnet powder to meet application requirements has been the focus of research.

The nitride rare-earth magnet powder is mainly prepared by nitriding rare-earth alloy powder at a certain temperature for a certain time, the rare-earth alloy powder can be prepared by many methods, including a mechanical alloying method and a rapid quenching method, for example, an isotropic SmFeN powder magnetic material for producing a resin bonded magnet is disclosed in both CN1196144C and JP2002057017, the crystal structure of which is $TbCu_7$ type, the powder is prepared by rapidly quenching a molten alloy and directly nitriding the obtained alloy powder in a nitrogen-containing gas.

A nitride rare-earth powder is disclosed in U.S. Pat. No. 5,750,044 which is also obtained through a rapid quenching and a subsequent nitridizing processing, the magnetic powder includes $TbCu_7$ or $Th_2Zn_{17}$ or $Th_2Ni_{17}$ and a soft magnetic phase, wherein the proportion of the soft magnetic phase is 10-60%. The nitride rare-earth powder, although partly improved in magnetic properties, needs to be researched further so as to meet the requirement of customers for a high-quality product and to be further improved in magnetic properties.

SUMMARY

The present disclosure aims at providing a rare-earth permanent magnetic powder, a bonded magnet and a device using the bonded magnet so as to improve the magnetic properties of a rare-earth permanent magnet powder.

To realize the purpose above, in accordance with an aspect of the disclosure, a rare-earth permanent magnetic powder is provided, the rare-earth permanent magnetic powder comprises: 70 vol % to 99 vol % of a hard magnetic phase and 1 vol % to 30 vol % of a soft magnetic phase, the hard magnetic phase has a $TbCu_7$ structure, and the grain size of the hard magnetic phase is 5 nm to 100 nm; the soft magnetic phase is a Fe phase having a bcc structure, the average grain size of the soft magnetic phase is 1 nm to 30 nm, and the standard deviation of the grain size is below $0.5\sigma$.

Further, in the rare-earth permanent magnetic powder, the grain size distribution of the hard magnetic phase is within a range of 5 nm to 80 nm, and preferably within a range of 5 nm to 50 nm.

Further, in the rare-earth permanent magnetic powder, the volume of the soft magnetic phase accounts for 3 vol % to 30 vol % of the volume of the rare-earth permanent magnetic powder, preferably, 5 vol % to −15 vol %.

Further, in the rare-earth permanent magnetic powder, the average grain size of the soft magnetic phase is 1 nm to 20 nm.

Further, in the rare-earth permanent magnetic powder, the standard deviation of the grain size of the soft magnetic phase is below $0.3\sigma$.

Further, the rare-earth permanent magnetic powder consists of R-T-M-A, wherein R is Sm or the combination of Sm with other rare-earth elements, T is Fe or the combination of Fe with Co, M is at least one of Ti, V, Cr, Zr, Nb, Mo, Ta, W, Si and Hf, A is N and/or C, and preferably, in the rare-earth permanent magnetic powder, the content of the R is 5 at. % to 12 at. %, that of the A is 10 at. % to 20 at. %, that of the M is 0 at. % to 10 at. %, and the balance is T.

Further, in the rare-earth permanent magnetic powder, the content of the R is 5 at. % to 10 at. %.

Further, in the R of the rare-earth permanent magnetic powder, the atomic content of Sm is 80 at. % to 100 at. %.

Further, in the rare-earth permanent magnetic powder, the T is the combination of Fe with Co, and the atomic content of Co is 0 at. % to 30 at. % in the T.

Further, in the rare-earth permanent magnetic powder, the thickness of the permanent magnetic powder is 5 μm to 50 μm.

In accordance with a second aspect of the disclosure, a bonded magnet is provided which is prepared by bonding the rare-earth permanent magnetic powder with a bonding agent.

In accordance with a third aspect of the disclosure, a device is provided which has the bonded magnet.

In accordance with a fourth aspect of the disclosure, a method for preparing the rare-earth permanent magnetic powder is provided, the preparation method comprises: generating a sheet-shaped alloy powder by feeding molten raw materials onto a rotating roller and rapidly quenching the raw materials; obtaining the rare-earth permanent magnetic powder by thermally treating the sheet-shaped alloy powder, and performing nitriding treatment or carbonizing treatment, wherein the step of generating a sheet-shaped alloy powder through the rapid quenching treatment comprises: spraying the molten raw materials onto the rotating roller, primarily cooling the molten raw materials to 850° C. to 950° C. at a cooling speed of $1\times10^{5}$° C./s to 80×105° C./s, and secondarily cooling the molten raw materials to 250° C. to 350° C. at a cooling speed of 0.5° C./s to 5° C./s to obtain the sheet-shaped alloy powder.

Further, during the thermal treatment process of the preparation method, the sheet-shaped alloy powder is heated at a heating speed of 10° C./s to 30° C./s, and thermally treated for 10 minutes to 150 minutes after the temperature reaches 600° C. to 900° C., and preferably, the sheet-shaped alloy powder is heated at a heating speed of 10° C./s to 20° C./s.

The rare-earth permanent magnetic powder provided in the disclosure is a biphase magnetic powder mainly formed by combining a hard magnetic phase having a $TbCu_7$ structure with a soft magnetic phase having a α-Fe structure, the biphase magnetic powder with a uniform microstructure, guarantees the uniform coupling of the soft magnetic phase and the hard magnetic phase and improves the magnetic properties of the rare-earth permanent magnetic powder.

DETAILED DESCRIPTION

It should be noted that embodiments of the disclosure and the features thereof can be combined with each other if no conflict is caused. The disclosure is described below in detail with reference to embodiments.

The microstructure of rare-earth permanent magnetic powder is of great importance for the performance of a material, a certain microstructure determines the coupling effect among crystals of a magnetic material, the forming of a magnetic domain, structure stability and many other aspects and finally influences the magnetic properties of the material. To improve the magnetic properties of rare-earth permanent magnetic powder, the inventor of the disclosure proposes the following technical solution based on a lot of research.

The rare-earth permanent magnetic powder provided herein consists of 70 vol % to 99 vol % of a hard magnetic phase and 1 vol % to 30 vol % of a soft magnetic phase, wherein the hard magnetic phase has a $TbCu_7$ structure, and the grain size of the hard magnetic phase is 5 nm to 100 nm; the soft magnetic phase is a Fe phase having a bcc structure, the average grain size of the soft magnetic phase is 1 nm to 30 nm, and the standard deviation of the grain size is below 0.5σ.

The rare-earth permanent magnetic powder provided herein is a biphase magnetic powder mainly formed by combining a hard magnetic phase having a $TbCu_7$ structure with a soft magnetic phase having an α-Fe structure. Compared with the widely used nitride magnetic powder of $Th_2Zn_{17}$ structure or $ThMn_{12}$ structure, the hard magnetic phase of $TbCu_7$ structure in the rare-earth permanent magnetic powder has better magnetic properties and therefore it is favorable for improving the magnetic properties of the prepared rare-earth permanent magnetic powder; meanwhile, a coupling effect can be generated between the soft magnetic phase of a Fe phase having a bcc structure and the hard magnetic phase having a $TbCu_7$ structure, the coupling effect inhibits the transformation of the $TbCu_7$ structure to a $Th_2Zn_{17}$ structure and the like, and avoids the deterioration of the magnetic properties of the rare-earth permanent magnetic powder caused by the transformation of the $TbCu_7$ structure to a $Th_2Zn_{17}$ or $ThMn_{12}$ phase in a crystallization, a nitridating and other stages. Further, as a soft magnetic phase, the Fe phase having a bcc structure also has a certain remanence enhancement effect, thus weakening the sensitivity of the magnetic powder to temperature and widening the range of the preparation technologies of the magnetic powder.

To fully realize the coupling effect of the soft magnetic phase and the hard magnetic phase, in the rare-earth permanent magnetic powder, the grain size of the crystals of the hard magnetic phase is preferably 5 nm to 100 nm. The reason lies in that the average grain size of the hard magnetic phase in rare-earth permanent magnetic powder being below 5 nm is unbeneficial to achieving a coercive force of above 5 kOe and makes it difficult to prepare the rare-earth permanent magnetic powder and consequentially leads to a low yield. when the average grain size of the hard magnetic phase is greater than 100 nm, the remanence of the hard magnetic phase is reduced, and the hard magnetic phase having the $TbCu_7$ structure cannot be coupled with the α-Fe phase, and the α-Fe phase not only can not inhibit the transformation from the $TbCu_7$ structure to a $Th_2Zn_{17}$ structure .edc but also it as a phase which degrades the performance the hard magnetic phase. To further improve the magnetic properties of the rare-earth permanent magnetic powder of the present disclosure, the grain size distribution of the hard magnetic phase is within a range of 5 nm to 80 nm, and preferably within a range of 5 nm to 50 nm.

In the rare-earth permanent magnetic powder of the present disclosure, the volume percent of the soft magnetic phase is preferably 1 vol % to 30 vol %. The volume of the soft magnetic phase being controlled within this range is beneficial to inhibiting the transformation from the $TbCu_7$ structure to a $Th_2Zn_{17}$ structure.edc and improving the magnetic properties of the prepared rare-earth permanent magnetic powder. If the content of the soft magnetic phase is below 1 vol %, the effect of the inhibition to the generation of other impure phases is weakened, however, if the content of the soft magnetic phase is above 30 vol %, although the generation of other impure phases such as $Th_2Zn_{17}$ is inhibited, the excessive soft magnetic phase greatly reduces the coercive force of the material, which is unbeneficial to improving the overall performance of the material. To further improve the magnetic properties of the rare-earth permanent magnetic powder of the present disclosure, the content of the soft magnetic phase is 3 vol % to 30 vol %, and preferably 5 vol % to 15 vol %.

In the rare-earth permanent magnetic powder of the present disclosure, the average grain size σ of the soft magnetic phase is preferably 1 nm to 30 nm, and the average grain size σ of the soft magnetic phase being controlled within this range can enhance remanence and improve the magnetic properties of the prepared rare-earth permanent magnetic powder. If the average grain size σ of the soft magnetic phase is too large, then no remanence enhancement effect can be achieved, moreover, the coercive force of the magnetic powder may be reduced. If the average grain size σ of the soft magnetic phase is too small, then it is difficult to prepare the crystals of the soft magnetic phase. More preferably, the average grain size of the soft magnetic phase in the rare-earth permanent magnetic powder is 1 nm to 20 nm.

In the rare-earth permanent magnetic powder of the present disclosure, the standard deviation of the grain size of the soft magnetic phase is below 0.5σ. The distribution of the soft magnetic phase in the magnetic powder is also critical to the magnetic properties of the magnetic powder, a uniform texture facilitating the uniform matching and the coupling of the soft magnetic phase and the hard magnetic phase and consequentially improving magnetic properties. In the rare-earth permanent magnetic powder of the present disclosure, by controlling the standard deviation of the average grain size of the soft magnetic phase to be below 0.5σ, the soft magnetic phase and the hard magnetic phase can be matched uniformly and coupled well to obtain a uniform fine texture. If the standard deviation of the grain size of the soft magnetic phase is higher than 0.5σ, then the too wide distribution of crystals makes it impossible to obtain a uniform fine texture, as a consequence, the contributing exchange interaction effect between the grains in the magnetic powder is reduced, resulting in the reduction of remanence which further disenables the coupling of the soft magnetic phase with the hard magnetic phase and the enhancement of remanence, and finally disenables the achievement of desirable magnetic properties. In the rare-earth permanent magnetic powder of the present disclosure, the standard deviation of the grain size of the soft magnetic phase is preferably 0.3σ.

In a preferred embodiment of the disclosure, the rare-earth permanent magnetic powder consists of R-T-M-A, wherein R is Y or the combination of Y with other rare-earth elements, T is Fe or the combination of Fe with Co, M is at least one of Ti, V, Cr, Mn, Ni, Cu, Zr, Nb, Mo, Ta, W, AL, Ga, Si and Hf, and A is N and/or C. Preferably, in the rare-earth permanent magnetic powder, the content of the R is 5 at. % to 12 at. %, the content of the A is 10 at. % to 20 at. %, the content of the M is 0 at. % to 10 at. %, and the balance is T.

In the rare-earth permanent magnetic powder consisting of R-T-M-A of the present disclosure, the element R is Sm or the combination of Sm with other rare-earth elements, wherein the R must contain Sm, which is a necessary condition for the generation of a hard magnetic phase of $TbCu_7$ structure and guaranteed magnetic properties.

The content of the element R is preferably within a range of 5 at. % to 12 at. %, and more preferably within a range of 5 at. % to 10 at. %. In the rare-earth permanent magnetic powder of the present disclosure, if the atomic content of the R is lower than 5 at. %, then the generated α-Fe soft magnetic phase is more, which will reduce the coercive force of the prepared magnetic powder; however, if the content of the R is higher than 12 at. %, then a structure like a samarium-rich phase is generated in a higher amount, neither of the situations is beneficial to improving magnetic properties. Preferably, in the rare-earth permanent magnetic powder of the present disclosure, the atomic content of Sm is 80 at. % to 100 at. %, and Sm can be partially replaced by rare-earth elements such as Ce and Y in an amount of not more than 20%, the addition of other rare-earth elements in a given amount contributes to improve the formability of the material, for example, less than 5 at. % of Ce and/or La may be added to reduce the melting point of the material, and Nd and/or Y may be added to improve the coercive force of the material, etc.

In the rare-earth permanent magnetic powder consisting of R-T-M-A of the present disclosure, the element T is Fe or the combination of Fe with Co, and preferably the combination of Fe with Co. The addition of Co in a given amount is beneficial to improving the remanence and temperature stability of a nitrogen-containing magnetic powder, simultaneity, the addition of Co in a given amount can achieve effects of stabilizing the structure of a metastable $TbCu_7$ phase and improving the wettability during a preparation process, etc. In view of cost and other factors, the atomic content of Co in the element T is 0 at. % to 30 at. %, wherein when the content of Co is 0 at. %, there is no Co contained in the element T.

An element M may be added into the rare-earth permanent magnetic powder consisting of R-T-M-A of the present disclosure, the M always refers herein to an element the melting point of which is higher than that of the rare-earth element Sm, the addition of such a high melting point element contributes to thin crystals and critically to generate a rare-earth permanent magnetic powder having a uniform microstructure and more importantly to inhibit the non-uniform growth of crystals during a crystallization and nitriding process, thus controlling the standard deviation of the grain size of the magnetic powder of the present disclosure within a given range. The M mainly includes, but is not limited to: one or more of Ti, V, Cr, Mn, Zr, Nb, Mo, Ta, W, Si and Hf, and the addition of the element M can thin crystals and improve magnetic properties such as coercive forth and remanence. Meanwhile, the atomic content the element M in the rare-earth permanent magnetic powder is preferably within a range of 0 at. % to 10 at. %, if the atomic content the element M is above 10 at. %, the magnetic properties such as remanence may be reduced.

An element A may be added into the rare-earth permanent magnetic powder consisting of R-T-M-A of the present disclosure, the element A is N and/or C, the addition of the element A into a rare-earth iron compound has a great influence on the performance of the rare-earth iron compound, this is called interstitial atom effect. The interstitial atom effect is capable of increasing the Curie temperature, a saturation magnetization intensity and an anisotropic field of a compound, the element A in the rare-earth permanent magnetic powder consisting of R-T-M-A preferably in a proportion of 10 at. % to 20 at. %, when the content of the element A is within the range, a magnetic powder having excellent magnetic properties can be obtained, the content of the element A is below 10 at. % indicate nitriding/carbonizing is incompletely, components are not uniform, and magnetic properties are reduced; the content of the element A is too high induces the hard magnetic phase decomposing and unbeneficial to improving the magnetic properties of the magnetic powder.

In a preferred embodiment of the disclosure, a rare-earth permanent magnetic powder consists of a hard magnetic phase having a $TbCu_7$ structure and a Fe phase having a bcc structure, wherein the soft magnetic phase of bcc structure is mainly a α-Fe phase, in the powder X-ray diffraction spectrum in which Cuka rays are used, the magnetic powder has less than one diffraction peak the intensity of which to the maximum peak intensity is greater than 10% within Bragg angle (2θ) ranges of 65-75 degrees. When there is no or one diffraction peak meeting the foregoing condition, the grain size and the distribution of the crystalline crystals in the prepared bonded magnetic powder are within the ranges limited in the present disclosure, and the prepared bonded magnetic powder has the optical matching performance.

In a preferred embodiment of the disclosure, the thickness of a rare-earth permanent magnetic powder is below 50 μm. The thickness of the magnetic powder is controlled to facilitate the uniform distribution of each phase in the magnetic powder and further optimize the properties of the magnetic powder such as the squareness of the magnetic powder. If the thickness is above 50 μm, then the crystal of each phase in a material cannot be uniformly distributed easily, which will finally degrade the properties of the magnetic powder such as the squareness of the magnetic powder, and unbeneficial to the permeation of nitrogen or carbon into a material crystal during a nitriding process. Preferably, the thickness of a rare-earth permanent magnetic powder is 5 μm to 50 μm, if the thickness is too small, it is difficult to prepare the rare-earth permanent magnetic powder, besides, there are many non-crystalline substances, which is unbeneficial to the consistency of the subsequent crystallization and nitriding process.

The rare-earth permanent magnetic powder of the present disclosure is prepared using a rapid quenching method, and the rare-earth permanent magnetic powder meeting the foregoing requirements can be prepared by the skilled person in the art under the teaching of the present disclosure. Currently, a common method includes the following steps: (1) melting all the raw materials, for example, R, T, M and A, etc., spraying the molten raw materials onto a rotating roller to obtain a sheet-shaped alloy powder; (2) thermally treating the sheet-shaped alloy powder for 10 minutes to 150 minutes at 600° C. to 900° C.; (3) performing nitriding treatment or carbonizing treatment on the thermally treated alloy powder at about 350° C. to 550° C. to obtain the rare-earth permanent magnetic powder.

The rare-earth permanent magnetic powder protected by the disclosure can be prepared by the skilled person in the art using the foregoing preparation method, however, to simplify the technical operation and improve the performance of the prepared rare-earth permanent magnetic powder, in a preferred embodiment of the present disclosure, a method for preparing the rare-earth permanent magnetic powder is provided which mainly includes the following preparation steps: rapidly quenching molten raw materials to generate a sheet-shaped alloy powder, thermally treating the sheet-shaped alloy powder, and performing nitriding treatment or carbonizing treatment on the thermally treated alloy powder to obtain the rare-earth permanent magnetic powder. The step of rapidly quenching molten raw materials to generate the sheet-shaped alloy powder includes: spraying the molten raw materials onto a rotating roller, primarily cooling the molten raw materials to 850° C. to 950° C. at a cooling speed of $1\times10^{5\circ}$ C./s to $80\times10^{5\circ}$ C./s; and secondarily cooling the molten raw materials to 250° C. to 350° C. at a cooling speed of 0.5° C./s to 5° C./s to obtain the sheet-shaped alloy powder.

Preferably, the step of rapidly quenching molten raw materials to generate a sheet-shaped alloy powder includes: spraying the molten raw material onto a rotating roller with a temperature from the melting points of the raw materials to 900° C., primarily cooling the molten raw materials to 880° C. to 920° C. at a cooling speed of $5\times10^{5\circ}$ C./s to $80\times10^{5\circ}$ C./s; and secondarily cooling the molten raw materials to 280° C. to 320° C. at a cooling speed of 0.5° C./s to −3° C./s, with the twice cooling to obtain the sheet-shaped alloy powder.

In the present disclosure, molten steel is splashed out after being processed by the rotating roller and then rapidly cooled to 850° C. to 950° C., and during this process, the speed of the rapid cooling is $1\times10^{5\circ}$ C./s to $80\times10^{5\circ}$ C./s at which an equilibrium phase cannot be formed and crystal cannot grow. The molten steel is splashed out after being treated, the splashed molten steel is secondarily cooled, in order to achieve a cooling speed of 0.5° C./s to 5° C./s, preferably, a guide baffle is added in the splashing direction of the sheet-shaped powder, so that the cooling speed of the sheet-shaped powder can be adjusted by controlling the distance between the guide baffle and the splash starting point of the sheet-shaped powder and the temperature of the guide baffle, etc.

By executing a rapidly quenching processing with two-step rapid cooling, the preparation method for a rare-earth permanent magnetic powder provided in the present disclosure can obtain a fine texture, besides, as the material is cooled at a relatively low cooling speed during a secondary cooling process, the method guarantees the stability of the grain size and consequentially inhibits the non-uniform overgrowth of the crystals of the rare-earth permanent magnetic powder and finally guarantees the magnetic properties of the rare-earth permanent magnetic powder.

In a preferred embodiment of the present disclosure, during the thermal treatment process of the preparation method for the rare-earth permanent magnetic powder, the sheet-shaped alloy powder is heated at a heating speed of 10° C./s to 30° C./s, preferably, at a heating speed of 10° C./s to 20° C./s, and then thermally treated for 10 minutes to 150 minutes after the temperature reaches 600° C. to 900° C., preferably, 600° C. to 850° C. Heating at a given speed is beneficial to keeping the stability in the whole heating range for the uniform growth of the powder, a too low heating speed will lead to a too long heating time, which is unbeneficial to controlling the thermal treatment process, on the other hand, a too high heating speed will make the powder heated non-uniformly. Preferably, in the present disclosure, the thermal treatment temperature is 600° C. to 900° C., a too high thermal treatment temperature will lead to the overgrowth of crystalline crystals, a too low thermal treatment temperature has no thermal treatment effect.

In the rare-earth permanent magnetic powder material provided in the present disclosure, the material of the roller is preferably, but is not limited to Cu, Mo and a Cu alloy; and in the nitriding or carbonizing step, the nitriding or carbonizing processing is preferably performed for 3-30 h; the nitrogen resource is preferably technical pure nitrogen or the mixture gas of hydrogen and ammonia, etc.

In a preferred embodiment of the present disclosure, the rare-earth permanent magnetic powder can be bonded with a bonding agent to generate a bonded magnet. The bonded magnet can be prepared by mixing the rare-earth permanent magnetic powder of the present disclosure (the primary phase of which is SmFeN powder of $TbCu_7$ structure) with a resin, and be performed a contour forging, an injection molding, a calendaring molding or an extrusion molding, etc. The prepared bonded magnet may take the shape of a block, a ring and others.

In a preferred embodiment of the present disclosure, the bonded magnet may be applied to preparing a corresponding device. By using the method, a high-performance SmFeN magnetic powder and a magnet can be prepared which are beneficial to the miniaturization of a device, and the excellent temperature resistance and corrosion resistance of the series of magnetic powders facilitates the use of a device in a special environment, and the application of the rare-earth samarium is also beneficial to the balanced application of rare earth resources.

The components, the grain size, and the grain size distribution, the magnetic powder performance, and the magnet performance of the rare-earth permanent magnetic powder of the present disclosure are described below with reference to specific embodiments to set forth the beneficial effects of the disclosure.

(1) Components of the Rare-Earth Permanent Magnetic Powder

The components of the rare-earth permanent magnetic powder were formed by nitridizing molten SmF alloy powder, and the components, which were components of nitridized magnetic powder, are represented by atomic percents.

(2) Grain Size σ

Average grain size representation method: a picture of the microstructure of a material was taken using an electron microscope, crystals of a hard magnetic phase of $TbCu_7$ structure and a soft magnetic phase of a α-Fe phase were observed, specifically, the total cross sectional area S of n crystals of the same type was statically calculated, then the cross sectional area S was equalized to the area of a circle, the diameter of the circle was calculated using the following formula as the grain size σ (unit: nm):

$$\sigma = 2\sqrt{\frac{S}{\pi n}}$$

(3) Grain Size Distribution

Grain size distribution is represented using a standard deviation and calculated using the following formula:

$$t = \sqrt{\frac{\sum_{i=1}^{n} (\sigma_i - \sigma)^2}{n-1}}$$

wherein, t is a standard deviation, and $\sigma_i$ is the size of the ith crystal.

In the present disclosure, in view of statistical accuracy and test condition, the value of n was not below 50.

(4) Properties of Magnetic Powder

The proprieties of the magnetic powder were calculated using a vibrating sample magnetometer (VSM).

Wherein, Br represents remanence (unit: kGs);

Hcj represents intrinsic coercive force (unit: KOe);

(BH)m represents magnetic energy product (unit: MGOe);

(5) Phase Proportion P %

The phase proportion was obtained by performing an area analysis on the metallograph of a magnetic material, and a volume ratio can be obtained by measuring the area ratio of a cross section;

(6) XRD Peak

An XRD measurement in which a Cu target was used was performed on the obtained alloy powder to study the phase structure of the magnetic powder.

In the diffraction spectrum obtained by performing an XRD peak detection on the rare-earth permanent magnetic powder prepared in the following embodiments 1 to 38, there was no or one diffraction peak the intensity of which to the maximum peak intensity was greater than 10% within Bragg angle (2θ) ranges of 65-75 degrees in each of the embodiments 1 to 38.

(7) Thickness λ

The thickness (unit: μm) is measured using a micrometer caliper.

Embodiments 1 to 8 (M is One Element, or Two Elements)

Preparation Method:

(1) The metals listed in the embodiments shown in Table 1 were proportionally mixed, fed into an induction melting furnace and smelted under the production of Ar gas to obtain an alloy ingot;

(2) The alloy ingot was coarsely crushed and fed into a rapid quenching furnace to be quenched rapidly, and a sheet-shaped alloy powder was obtained after the rapid quenching, a protection gas was Ar gas, an injection pressure was 80 kPa, the diameter of a nozzle was 0.8 mm, the linear speed of a water cooed roller was 55 m/s.

(3) The alloy powder was treated for 55 minutes at 750° C. under the protection of Ar gas and then fed into a 0.1 Mpa $N_2$ atmosphere to be nitrided to obtain a nitride magnetic powder, the conditions of the nitriding treatment were 460° C. and 7 hours.

Detect: detect the magnetic properties, the grain size, the grain size distribution and the phase proportion of the prepared rare-earth permanent magnetic powder (the components of the prepared rare-earth permanent magnetic powder are shown in Table 1), and the results of the detection as shown in Table 2, S represents an embodiment, and D represents a comparative sample.

TABLE 1

| components of material | |
|---|---|
| Sample number | Components (bal represents the balance) |
| S1 | $Sm_{5.0}Fe_{bal}Co_{3.0}Zr_{0.3}N_{12.9}$ |
| S2 | $Sm_{6.5}Fe_{bal}Co_{3.8}Zr_{2.1}Si_{0.8}N_{12.5}$ |
| S3 | $Sm_{7.1}Fe_{bal}Co_{27.2}Mo_{1.5}Si_{0.2}N_{12.5}$ |
| S4 | $Sm_{7.3}Fe_{bal}Co_{23.6}Zr_{1.2}Al_{0.3}N_{12.2}$ |
| S5 | $Sm_{7.7}Fe_{bal}Co_{3.1}Ga_{1.7}Nb_{0.3}N_{13.2}$ |
| S6 | $Sm_{7.6}Fe_{bal}Co_{13.0}Zr_{1.5}V_{1.3}N_{14.0}$ |
| S7 | $Sm_{8.1}Fe_{bal}Co_{18.0}Hf_{1.6}Ti_{2.2}N_{13.5}$ |
| S8 | $Sm_{8.5}Fe_{bal}Co_{10.6}Zr_{0.8}N_{12.5}$ |
| D1 | $Sm_{8.5}Fe_{bal}Co_{10.6}Zr_{0.8}N_{12.5}$ |
| D2 | $Sm_{8.5}Fe_{bal}Co_{10.6}Zr_{0.8}N_{12.5}$ |
| D3 | $Sm_{8.5}Fe_{bal}Co_{10.6}Zr_{0.8}N_{12.5}$ |

TABLE 2

| Structure and properties of material | | | | | | | | | |
|---|---|---|---|---|---|---|---|---|---|
| | | Hard magnetic phase | | Soft magnetic phase | | | Properties of magnetic powder | | |
| Sample | λ (μm) | σ (nm) | P % | P % | σ (nm) | t | Br(kGs) | Hcj(kOe) | (BH)m(MGOe) |
| S1 | 20 | 47 | 83 | 14 | 17 | 6.5 | 9.5 | 8.1 | 17.2 |
| S2 | 15 | 8 | 89 | 8 | 8 | 1.3 | 9.6 | 8.9 | 18.6 |
| S3 | 11 | 30 | 82 | 15 | 11 | 3.6 | 9.3 | 8.6 | 17.2 |
| S4 | 19 | 45 | 85 | 13 | 1 | 0.9 | 9.1 | 8.4 | 17.7 |
| S5 | 17 | 24 | 85 | 14 | 15 | 5.6 | 9.3 | 8.3 | 17.3 |
| S6 | 15 | 25 | 87 | 11 | 9 | 2.6 | 9.6 | 8.2 | 18.7 |
| S7 | 18 | 41 | 93 | 5 | 8 | 1.1 | 9.7 | 8.1 | 18.8 |
| S8 | 19 | 33 | 89 | 10 | 9 | 3.8 | 9.3 | 8.3 | 17.5 |
| S9 | 20 | 57 | 82 | 16 | 13 | 4.1 | 9.2 | 8.0 | 17.1 |
| S10 | 22 | 71 | 80 | 18 | 15 | 4.9 | 9.1 | 7.9 | 17.0 |
| D1 | 21 | 65 | 85 | 14 | 32 | 11 | 7.3 | 3.5 | 14.2 |
| D2 | 20 | 68 | 83 | 16 | 13 | 10 | 7.1 | 4.5 | 13.5 |
| D3 | 61 | 103 | 86 | 9 | 23 | 12 | 6.8 | 5.2 | 13.2 |

It can be seen from the embodiments above that relatively high magnetic properties, referring mainly to coercive force and magnetic energy product, can be obtained when the grain size and the grain size distribution of the magnetic powders are within the ranges protected in the present disclosure. It can be seen from the comparison of D1 with D2 that when the grain size and the grain size distribution are deviated from the protected ranges, even if the soft magnetic phase of a α-Fe phase exists in the magnetic powder, the coarse, big and non-uniformly distributed crystals reduce, rather than improving, remanence, and coercive force is also greatly reduced. Wherein, the grain size of the crystals of the soft magnetic phase is greater than 30 nm in D1, t is equal to or greater than 0.5σ in D2, and the magnetic properties are greatly reduced in both D1 and D2. It can also be seen from the embodiments that the performance of the material is relatively high when the standard deviation t of the crystals of the soft magnetic phase is equal to or smaller than 0.5σ and highest when t is equal to or smaller than 0.3σ. Besides, it can be seen from the comparison of the embodiment with D3 that when crystals of the hard magnetic phase is too big, the magnetic properties is greatly reduced, and as the grain sizes of crystals of the hard magnetic phase of the embodiments are within 5-50 nm, the materials also have relatively high magnetic properties. The magnetic properties of the material are relatively excellent when the grain size distribution of the hard magnetic phase is within the range of 5 nm to 80 nm, and preferably within the range of 5 nm to 50 nm.

Embodiments 9 to 13 (M is the Mixture of a Plurality of Elements)

Preparation Method:

(1) The metals listed in the embodiments shown in Table 3 were proportionally mixed, fed into an induction melting furnace and smelted under the production of Ar gas to obtain an alloy ingot;

(2) The alloy ingot was coarsely crushed and fed into a rapid quenching furnace to be quenched rapidly, and a sheet-shaped alloy powder was obtained after the rapid quenching, a protection gas was Ar gas, an injection pressure was 80 kPa, the diameter of a nozzle was 0.8 mm, the linear speed of a water cooed roller was 55 m/s.

(3) The alloy powder was treated for 55 minutes at 750° C. under the protection of Ar gas and then fed into a 0.1 Mpa $N_2$ atmosphere to be nitrided to obtain a nitride magnetic powder, the conditions of the nitriding treatment were 460° C. and 7 hours.

Detect: detect the magnetic properties, the grain size, the grain size distribution and the phase proportion of the prepared rare-earth permanent magnetic powder (the components of the prepared rare-earth permanent magnetic powder are shown in Table 3), and the results of the detection as shown in Table 4, S represents an embodiment, and D represents a comparative sample.

TABLE 3

| components of material | |
|---|---|
| | Components (bal represents the balance) |
| S9 | $Sm_{8.5}Fe_{bal}Co_{4.2}Zr_{2.4}Ga_{1.1}Cr_{1.5}N_{13.5}$ |
| S10 | $Sm_{9.3}Fe_{bal}Co_{8.1}Hf_{0.5}Mn_{0.5}Ni_{0.5}N_{12.5}$ |
| S11 | $Sm_{5.0}Fe_{bal}Co_{15.7}Zr_{3.1}W_{0.7}Al_{0.2}N_{10.6}$ |
| S12 | $Sm_{6.2}Fe_{bal}Co_{11.9}Hf_{4.3}Cu_{3.5}V_{2.2}N_{12.3}$ |
| S13 | $Sm_{7.3}Fe_{bal}Co_{21.0}Zr_{1.3}Ta_{0.2}Si_{0.2}N_{12.5}$ |
| D4 | $Sm_{6.2}Fe_{bal}Co_{11.9}Hf_{0.5}Cu_{1.5}V_{0.2}N_{12.3}$ |
| D5 | $Sm_{7.3}Fe_{bal}Co_{21.0}Zr_{1.3}Ta_{0.2}Si_{0.2}N_{12.5}$ |

TABLE 4

| Structure and properties of material | | | | | | | | | |
|---|---|---|---|---|---|---|---|---|---|
| | | Hard magnetic phase | | Soft magnetic phase | | | Properties of magnetic powder | | |
| Sample | λ (μm) | σ (nm) | P % | P % | σ (nm) | t | Br(kGs) | Hcj(kOe) | (BH)m(MGOe) |
| S9 | 27 | 35 | 75 | 25 | 16 | 7.4 | 8.7 | 7.6 | 16.1 |
| S10 | 14 | 33 | 85 | 15 | 15 | 4.1 | 9.3 | 8.2 | 16.9 |
| S11 | 18 | 25 | 81 | 17 | 13 | 2.3 | 9.1 | 8.4 | 16.8 |
| S12 | 50 | 100 | 76 | 19 | 18 | 4.1 | 8.8 | 7.7 | 16.3 |
| S13 | 9 | 25 | 78 | 21 | 8 | 1.9 | 9.1 | 8.1 | 16.6 |
| D4 | 61 | 93 | 82 | 16 | 43 | 35 | 6.7 | 4.1 | 10.5 |
| D5 | 75 | 112 | 73 | 26 | 61 | 44.5 | 5.3 | 4.6 | 6.9 |

It can be seen from the embodiments and comparative samples above that the intrinsic magnetic properties of the material are slightly reduced when a plurality of elements M are added with respect to the case where one or two M elements are added, this is mainly because that transition elements are lower in saturation magnetic moment than Fe and Co, the addition of more elements decreases the saturation magnetic moment of the material and consequentially slightly reduces part of magnetic properties of the material.

Likewise, the coercive force of the material is greatly reduced when the grain size and the grain size distribution are deviated from the protected ranges, and although the soft magnetic phase of a α-Fe phase exists in the magnetic powder, the coarse, big and non-uniformly distributed crystals reduce, rather than improving, remanence. It can also be seen from the data in Table 4 that the properties of the material are relatively high when the standard deviation t of the crystals of the soft magnetic phase is equal to or smaller than 0.5σ and highest when t is equal to or smaller than 0.3σ.

Embodiments 14 to 16 (SmFeN Type Permanent Magnetic Powder)

Preparation Method:

(1) The SmFe alloy listed in the embodiments shown in Table 5 were proportionally mixed, fed into an induction melting furnace and smelted under the production of Ar gas to obtain an alloy ingot;

(2) The alloy ingot was coarsely crushed and fed into a rapid quenching furnace to be quenched rapidly, and a sheet-shaped alloy powder was obtained after the rapid quenching, a protection gas was Ar gas, an injection pressure was 100 kPa, the diameter of a nozzle was 0.8 mm, the linear speed of a water cooed roller was 55 m/s.

(3) The alloy powder was treated for 60 minutes at 730° C. under the protection of Ar gas and then fed into a 0.1 Mpa $N_2$ atmosphere to be nitrided to obtain a nitride magnetic powder, the conditions of the nitriding treatment were 440° C. and 8 hours.

Detect: detect the magnetic properties, the grain size, the grain size distribution and the phase proportion of the prepared rare-earth permanent magnetic powder (the components of the prepared rare-earth permanent magnetic powder are shown in Table 5), and the results of the detection as shown in Table 6, S represents an embodiment, and D represents a comparative sample.

TABLE 5

| components of material | |
|---|---|
| | Components (bal represents the balance) |
| S14 | $Sm_{8.0}Fe_{bal}N_{13.0}$ |
| S15 | $Sm_{7.5}Fe_{bal}N_{12.5}$ |
| S16 | $Sm_{7.3}Fe_{bal}N_{12.5}$ |
| D6 | $Sm_{8.0}Fe_{bal}N_{13.0}$ |
| D7 | $Sm_{7.3}Fe_{bal}N_{12.5}$ |

TABLE 6

| Structure and properties of material | | | | | | | | | |
|---|---|---|---|---|---|---|---|---|---|
| | | Hard magnetic phase | | Soft magnetic phase | | | Properties of magnetic powder | | |
| Sample | λ | σ | P % | P % | σ | t | Br | Hcj | (BH)m |
| S14 | 21 | 25 | 88 | 10 | 6 | 2.4 | 8.7 | 6.4 | 16.1 |
| S15 | 11 | 31 | 88 | 11 | 17 | 3.8 | 8.9 | 6.5 | 16.7 |
| S16 | 18 | 37 | 86 | 14 | 19 | 4.2 | 9.1 | 6.9 | 16.9 |
| D6 | 61 | 93 | 82 | 17 | 43 | 35 | 6.3 | 4.7 | 9.5 |
| D7 | 75 | 112 | 73 | 26 | 61 | 44.5 | 5.6 | 3.9 | 5.3 |

It can be seen from the data in Table 6 that when Co and transition metals M are not added in the prepared magnetic powder, the crystal of the soft magnetic phase is relatively large, and the magnetic properties of the prepared magnetic powder are also slightly lower than those achieved in a case where Co and transition metals M are added, nonetheless, the properties of the prepared magnetic powder are still relatively high when the grain size distribution t is equal to or smaller than 0.5σ and highest when the grain size distribution t is equal to or smaller than 0.3σ

Embodiments 17 to 21

SmRFeCoMN Type Magnetic Powder

Preparation Method:

(1) The related rare earths and transition metals listed in the embodiments shown in Table 7 were proportionally mixed, fed into an induction melting furnace and smelted under the production of Ar gas to obtain an alloy ingot;

(2) The alloy ingot was coarsely crushed and fed into a rapid quenching furnace to be quenched rapidly, and a sheet-shaped alloy powder was obtained after the rapid quenching, a protection gas was Ar gas, an injection pressure was 80 kPa, the diameter of a nozzle was 0.7 mm, the linear speed of a water cooed roller was 55 m/s, the diameter of a copper roller was 300 mm.

(3) The alloy powder is treated for 70 minutes at 700° C. under the protection of Ar gas and then fed into a 0.1 Mpa $N_2$ atmosphere to be nitrided to obtain a nitride magnetic powder, the conditions of the nitriding treatment were 450° C. and 6 hours.

Detect: detect the magnetic properties, the grain size, the grain size distribution and the phase proportion of the prepared rare-earth permanent magnetic powder (the components of the prepared rare-earth permanent magnetic powder are shown in Table 7), and the results of the detection as shown in Table 8, S represents an embodiment, and D represents a comparative sample.

TABLE 7

| components of material | |
|---|---|
| | Components (bal represents the balance) |
| S17 | $Sm_{8.5}La_{0.3}Fe_{bal}Co_{15.6}Zr_{0.5}N_{12.3}$ |
| S18 | $Sm_{8.5}Ce_{0.3}Fe_{bal}Co_{11.3}V_{0.5}N_{12.7}$ |
| S19 | $Sm_{8.0}Pr_{2.0}Fe_{bal}Co_{15.6}Zr_{0.5}N_{12.6}$ |
| S20 | $Sm_{8.5}Nd_{0.2}Fe_{bal}Co_{13.7}Si_{0.2}N_{12.0}$ |
| S21 | $Sm_{8.5}Gd_{0.3}Fe_{bal}Co_{17.9}Ga_{0.5}N_{20.0}$ |
| D6 | $Sm_{8.5}La_{0.3}Fe_{bal}Co_{15.6}Zr_{0.5}N_{12.3}$ |
| D7 | $Sm_{7.5}Pr_{2.5}Fe_{bal}Co_{15.6}Zr_{0.5}N_{12.6}$ |

TABLE 8

| Structure and properties of material | | | | | | | | | |
|---|---|---|---|---|---|---|---|---|---|
| | | Hard magnetic phase | | Soft magnetic phase | | | Properties of magnetic powder | | |
| Sample | λ | σ | P % | P % | σ | t | Br | Hcj | (BH)m |
| S17 | 17 | 35 | 86 | 12 | 5 | 2.1 | 7.3 | 6.8 | 16.1 |
| S18 | 15 | 22 | 85 | 14 | 14 | 2.7 | 7.4 | 6.9 | 15.5 |
| S19 | 25 | 47 | 70 | 30 | 20 | 8.1 | 7.3 | 6.0 | 15.1 |
| S20 | 13 | 33 | 87 | 13 | 15 | 3.5 | 8.1 | 7.1 | 17.8 |
| S21 | 24 | 49 | 85 | 14 | 9 | 3.4 | 7.8 | 6.9 | 15.6 |
| D6 | 45 | 74 | 89 | 7 | 45 | 32 | 6.7 | 4.1 | 9.6 |
| D7 | 52 | 91 | 86 | 12 | 51 | 46 | 5.8 | 3.6 | 7.7 |

It can be seen from the data in Table 8 that the prepared magnetic powders added with a rare-earth element R are partially reduced in remanence, but the powders still have a relatively high performance in all aspects when the grain size distribution t is equal to or smaller than 0.5σ and a highest performance when the grain size distribution t is equal to or smaller than 0.3σ (S18 and S20). It can be seen from S19 that as the rare earth content is high, remanence and magnetic energy product are reduced greatly while coercive force is relatively high.

Embodiments 22 to 30 (Carbon-Containing Permanent Magnetic Powder)

Preparation Method:

(1) High-purity metals were proportionally mixed, fed into an induction melting furnace and smelted under the production of Ar gas to obtain an alloy ingot;

(2) The alloy ingot was coarsely crushed and fed into a rapid quenching furnace to be quenched rapidly, and a sheet-shaped alloy powder was obtained after the rapid quenching, a protection gas was of Ar gas, an injection pressure was 80 kPa, the diameter of a nozzle was 0.8 mm, the linear speed of a water cooed roller was 50 m/s, the diameter of a copper roller was 300 mm.

(3) The alloy was treated for 70 minutes at 710° C. under the protection of Ar gas, then the magnetic powder was coarsely crushed until the grain size thereof was below 100 μm, the crushed powder was mixed with carbon powder and treated for 7 hours at 480° C. to obtain a carbide magnetic powder.

Detect: detect the magnetic properties, the grain size, the grain size distribution and the phase proportion of the prepared rare-earth permanent magnetic powder (the components of the prepared rare-earth permanent magnetic powder are shown in Table 9), and the results of the detection as shown in Table 10, S represents an embodiment, and D represents a comparative sample.

TABLE 9

| components of material | |
|---|---|
| Sequence number | Components (bal represents the balance) |
| S22 | $Sm_{6.8}Fe_{bal}Co_{23.0}Zr_{1.5}C_{0.2}N_{13.0}$ |
| S23 | $Sm_{6.7}Fe_{bal}Co_{11.6}Zr_{2.1}Ti_{4.0}Ta_{0.3}C_{10.4}$ |
| S24 | $Sm_{7.2}Fe_{bal}Co_{18.3}Hf_{0.5}Al_{0.2}Ti_{0.3}C_{12.5}$ |
| S25 | $Sm_{7.8}Fe_{bal}CoZr_{2.4}Si_{0.7}Al_{3.3}C_{10.0}N_{3.1}$ |
| S26 | $Sm_{8.5}Fe_{bal}Co_{0.5}Hf_{2.1}Mn_{0.3}V_{1.5}C_{0.9}N_{14.1}$ |
| S27 | $Sm_{8.7}Fe_{bal}Co_{1.5}Zr_{1.7}C_{5.5}N_{6.5}$ |
| S28 | $Sm_{8.5}Fe_{bal}Co_{22.1}Zr_{2.1}Ta_{0.1}Gr_{0.2}C_{1.5}N_{12.6}$ |
| S29 | $Sm_{8.9}Fe_{bal}Ga_{1.7}C_{13.1}$ |
| S30 | $Sm_{5.0}Fe_{bal}Hf_{1.9}Al_{0.1}C_{0.9}N_{14.0}$ |
| D8 | $Sm_{6.8}Fe_{bal}Co_{23.0}Zr_{1.5}C_{0.2}N_{13.0}$ |
| D9 | $Sm_{7.8}Fe_{bal}CoZr_{2.4}Si_{0.7}Al_{3.3}C_{1.0}N_{13}$ |
| D10 | $Sm_{8.9}Fe_{bal}Ga_{1.7}C_{13.1}$ |

TABLE 10

| Structure and properties of material | | | | | | | | | |
|---|---|---|---|---|---|---|---|---|---|
| | | Hard magnetic phase | | Soft magnetic phase | | | Properties of magnetic powder | | |
| Sample | λ | σ | P % | P % | σ | t | Br | Hcj | (BH)m |
| S22 | 23 | 32 | 85 | 10 | 16 | 2.3 | 8.7 | 8.9 | 18.1 |
| S23 | 5 | 5 | 86 | 13 | 13 | 1.5 | 8.3 | 6.9 | 17.9 |
| S24 | 19 | 52 | 81 | 16 | 23 | 5.2 | 8.1 | 6.2 | 16.3 |
| S25 | 17 | 40 | 82 | 13 | 3 | 4.9 | 8.5 | 9.0 | 18.4 |
| S26 | 15 | 22 | 85 | 13 | 18 | 8.1 | 8.2 | 7.2 | 17.6 |
| S27 | 11 | 20 | 85 | 13 | 17 | 3.4 | 8.7 | 9.1 | 18.0 |
| S28 | 11 | 34 | 87 | 10 | 19 | 7.9 | 8.4 | 7.8 | 17.5 |
| S29 | 9 | 25 | 87 | 11 | 15 | 5.7 | 8.9 | 8.9 | 18.3 |
| S30 | 22 | 30 | 80 | 19 | 30 | 6.3 | 7.9 | 6.1 | 16.1 |
| D8 | 45 | 83 | 82 | 24 | 43 | 25 | 7.1 | 5.9 | 11.4 |
| D9 | 67 | 142 | 75 | 15 | 64 | 42 | 6.5 | 3.5 | 9.2 |
| D10 | 53 | 93 | 80 | 14 | 51 | 37 | 6.1 | 5.1 | 8.9 |

It can be seen from the data in Table 10 that the prepared rare-earth magnetic powders added with the element C still have relatively high magnetic properties and a magnetic energy product of above 15MGOe, besides, the performance of the prepared rare-earth magnetic powder is still relatively high when the grain size distribution t thereof is equal to or smaller than 0.5σ and highest when the grain size distribution t is equal to or smaller than 0.3σ.

Embodiment 31 to 38

The preparation method for a rare-earth permanent magnetic powder of the present disclosure is mainly used to prepare a $Sm_{85}Fe_{bal}CO_{10.6}Zr_{0.8}N_{12.5}$ bonded magnetic powder mainly through the following preparation steps:

(1) The high-purity metals listed in the embodiments shown in Tab. 11 were proportionally mixed, fed into an induction melting furnace and smelted under the production of Ar gas to obtain an alloy ingot;

(2) The alloy ingot was coarsely crushed and fed into a rapid quenching furnace to be quenched rapidly, a protection gas was Ar gas, the injection pressure of a nozzle was controlled to be 80 kPa, the diameter of the nozzle was 0.8 mm, the crushed alloy ingot was sprayed onto a rotating roller to be cooled primarily, a baffle is also arranged to secondarily cool the alloy ingot to obtain a sheet-shaped alloy powder (the material and the wheel speed of the roller, the primary cooling temperature and the secondary cooling temperature are shown in Table 11);

(3) The alloy was heated under the protection of Ar gas and then thermally treated (heating speed, the temperature reached at the heating and thermal treatment time are shown in FIG. 11) with the temperature kept; the magnetic powder is coarsely crushed until the grain size thereof was below 100 μm, the crushed powder was treated in a $N_2$ atmosphere to obtain a carbon nitride compound magnetic powder (nitriding temperature and nitriding time are shown in Table 11).

Detect: detect the magnetic properties, the grain size, the grain size distribution and the phase proportion of the prepared rare-earth permanent magnetic powder (the components of the prepared rare-earth permanent magnetic powder are shown in Table 11), and the results of the detection as shown in Table 10, S represents an embodiment, and D represents a comparative sample.

Unit of the Detection Data Involved in the Technology:

Heating speed: ° C./s, cooling speed: ° C./s, wheel speed of rapid quenching: m/s, crystallization temperature and nitriding temperature: ° Q crystallization time: min, and nitriding time: h.

TABLE 11

| specific preparation of magnetic powder and final magnetic properties of magnetic powder | | | | | | | | | |
|---|---|---|---|---|---|---|---|---|---|
| | Rapid quenching | | | | Thermal treatment | | | | |
| | Primary | Secondary | | Wheel | Heating | | | Nitriding | |
| Number | cooling | cooling | Material | speed | speed | Temperature | Time | Temperature | Time |
| S31 | $8 \times 10^{5\circ}$ C./s-$3 \times 10^{6\circ}$ C./s | 0.5-1°C./s | Mo | 46 | 13 | 700-750 | 55 | 460 | 7 |
| S32 | $5 \times 10^{5\circ}$ C./s-$1 \times 10^{6\circ}$ C./s | 0.5-5°C./s | Be Cu | 50 | 25 | 600-630 | 150 | 550 | 3 |
| S33 | $5 \times 10^{5\circ}$ C./s-$1 \times 10^{6\circ}$ C./s | 0.5-5°C./s | Cu | 60 | 15 | 700-750 | 70 | 450 | 17 |
| S34 | $5 \times 10^{5\circ}$ C./s-$1 \times 10^{6\circ}$ C./s | 0.5-3°C./s | Mo | 60 | 10 | 710-750 | 70 | 450 | 15 |
| S35 | $1 \times 10^{6\circ}$ C./s-$5 \times 10^{6\circ}$ C./s | 0.5-3°C./s | Mo | 60 | 15 | 750-800 | 60 | 450 | 20 |
| S36 | $1 \times 10^{6\circ}$ C./s-$3 \times 10^{6\circ}$ C./s | 0.5-4°C./s | Cr Cu | 58 | 15 | 730-780 | 50 | 450 | 15 |
| S37 | $5 \times 10^{5\circ}$ C./s-$8 \times 10^{6\circ}$ C./s | 0.5-5°C./s | Mo | 55 | 20 | 730-780 | 50 | 420 | 24 |
| S38 | $1 \times 10^{5\circ}$ C./s-$5 \times 10^{5\circ}$ C./s | 0.5-5°C./s | Mo | 55 | 30 | 850-900 | 10 | 350 | 30 |
| D11 | $5 \times 10^{6\circ}$ C./s-$1 \times 10^{7\circ}$ C./s | 0.2-0.5° C.C. | Mo | 65 | 15 | 700-750 | 60 | 440 | 18 |
| D12 | $1 \times 10^{5\circ}$ C./s-$5 \times 10^{5\circ}$ C./s | 0.2-0.5° C.C. | Be Cu | 53 | 9 | 590-630 | 180 | 440 | 18 |

TABLE 12

| Structure and properties of material | | | | | | | | | |
|---|---|---|---|---|---|---|---|---|---|
| | | Hard magnetic phase | | Soft magnetic phase | | | Properties of magnetic powder | | |
| Sample | λ | σ | P % | P % | σ | t | Br | Hcj | (BH)m |
| S31 | 25 | 55 | 88 | 11 | 7 | 3.1 | 8.1 | 7.1 | 16.3 |
| S32 | 21 | 43 | 83 | 13 | 11 | 3.1 | 7.5 | 6.8 | 15.4 |
| S33 | 13 | 35 | 87 | 12 | 15 | 2.7 | 9.1 | 7.5 | 17.6 |
| S34 | 15 | 27 | 85 | 14 | 9 | 2.2 | 9.2 | 7.7 | 17.5 |
| S35 | 16 | 31 | 88 | 10 | 20 | 9.5 | 8.7 | 7.5 | 17.3 |
| S36 | 18 | 37 | 83 | 15 | 13 | 3.7 | 9.3 | 8.1 | 18.1 |
| S37 | 20 | 35 | 85 | 13 | 11 | 1.9 | 8.9 | 7.3 | 17.1 |
| S38 | 19 | 63 | 81 | 12 | 47 | 22 | 7.1 | 5.4 | 15.1 |
| D11 | 10 | 25 | 87 | 12 | 8 | 1.9 | 7.9 | 7.4 | 17.3 |
| D12 | 27 | 41 | 86 | 13 | 15 | 4.5 | 7.3 | 7.1 | 17.1 |

The rare-earth permanent magnetic powder provided in the present disclosure can be prepared using a rapid quenching method, and the skilled person in the art can prepare the rare-earth permanent magnetic powder protected in the present disclosure by rationally using ordinary rapid quenching methods and adjusting the parameters involved in each step, for example, the methods used in the embodiments S1-S30. A rapid quenching processing of two-step cooling is preferably adopted in the present disclosure, and it can be seen from the data in Tables 11 and 12 that by executing a rapid quenching processing of two-step cooling, a fine structure was obtained, besides, as the material was cooled at a relatively low cooling speed during a secondary cooling process, the stability of grain size was guaranteed, the non-uniform overgrowth of the crystals of the rare-earth alloy powder during the thermal treatment was consequentially inhibited, and it can be seen from the technology above that by combining a secondary cooling and subsequent thermal treatment and nitriding processing, the grain size distribution t of the prepared material is equal to or smaller than 0.5σ, thus achieving excellent magnetic properties.

It can be seen from above, the primary phase of the material provided in the present disclosure is compounded by a $TbCu_7$ structure and a bcc soft magnetic phase structure, the magnetic properties of the material are improved by controlling the grain size and the grain size distribution. Besides, according to the present disclosure, a bonded magnet can be prepared by mixing and bonding the magnetic powder with a bonding agent, the bonded magnet can be applied in motor, sound equipment, measuring instrument and the like.

The above are only preferred embodiments of the present disclosure and should not be used for limiting the present disclosure. For those skilled in the art, the present disclosure may have various modifications and changes. Any modifications, equivalent replacements, improvements and the like within the spirit and principle of the present disclosure shall fall within the scope of protection of the present disclosure.

What is claimed is:

1. A preparation method for rare-earth permanent magnetic powder, the preparation method comprises:

generating a sheet-shaped alloy powder by feeding molten raw materials onto a rotating roller and rapidly quenching the raw materials;

obtaining the rare-earth permanent magnetic powder by thermally treating the sheet-shaped alloy powder, and performing nitriding treatment or carbonizing treatment on the thermally treated alloy powder: wherein the step of generating a sheet-shaped alloy powder through the rapid quenching treatment comprises a two-step cooling comprising:

spraying the molten raw materials onto a rotating roller with a temperature from the melting points of the raw materials to 900° C., primarily cooling the molten raw materials to 880° to 920° at a cooling speed of $5 \times 10^{5\circ}$ C./s to $80 \times 10^{5\circ}$ C./s, and secondarily cooling the molten raw materials to 280° C. to 320° C. at a cooling speed of 0.5° C./s to 3° C./s, and wherein during the thermal treatment process, the sheet-shaped alloy powder is heated to 600-900 degrees centigrade at a heating speed of 10° C./s to 20° C./s and then thermally treated for 10 to 150 minutes.

2. A rare-earth permanent magnetic powder prepared by the method of claim 1, wherein the rare-earth permanent magnetic powder comprises: 70 vol % to 99 vol % of a hard magnetic phase and 1 vol % to 30 vol % of a soft magnetic phase; wherein the hard magnetic phase is a $TbCu_7$ structure, and the grain size of the hard magnetic phase is 5 nm to 100 nm; and wherein the soft magnetic phase is a Fe phase having a bcc structure, the average grain size of the soft magnetic phase is 1 nm to 30 nm, and the standard deviation of the grain size of the soft magnetic phase is below 0.3α.

3. The rare-earth permanent magnetic powder according to claim 2, wherein grain size distribution of the hard magnetic phase is within a range of 5 nm to 80 nm.

4. The rare-earth permanent magnetic powder according to claim 2, wherein a volume of the soft magnetic phase accounts for 3 vol % to 30 vol % of a volume of the rare-earth permanent magnetic powder.

5. The rare-earth permanent magnetic powder according to claim 2, wherein the average grain size of the soft magnetic phase is 1 nm to 20 nm.

6. The rare-earth permanent magnetic powder according to claim 2, wherein the rare-earth permanent magnetic powder consists of R-T-M-A, wherein R is Sm or the combination of Sm with other rare-earth elements, T is Fe or the combination of Fe with Co, M is at least one of Ti, V, Cr, Zr, Nb, Mo, Ta, W, Si and Hf, A is N and/or C, and optionally, in the rare-earth permanent magnetic powder, the content of the R is 5 at. % to 12 at. %, that of the A is 10 at. % to 20 at. %, that of the M is 0 at. % to 10 at. %, and the balance is T.

7. The rare-earth permanent magnetic powder according to claim 2, wherein in the rare-earth permanent magnetic powder, the content of the R is 5 at. % to 10 at. %.

8. The rare-earth permanent magnetic powder according to claim 2, wherein in the R, the atomic content of Sm is 80 at. % to 100 at. %.

9. The rare-earth permanent magnetic powder according to claim 2, wherein the T is the combination of Fe with Co, and the atomic content of Co is 0 at. % to 30 at. % in the T.

10. The rare-earth permanent magnetic powder according to claim 2, wherein the thickness of the permanent magnetic powder is 5 pm to 50 pm.

11. The rare-earth permanent magnetic powder according to claim 3, wherein the grain size distribution of the hard magnetic phase is within the range of 5 nm to 50 nm.

12. The rare-earth permanent magnetic powder according to claim 4, wherein the volume of the soft magnetic phase accounts for 5 vol % to 15 vol % of the volume of the rare-earth permanent magnetic powder.

13. A bonded magnet, wherein the bonded magnet is prepared by bonding the rare-earth permanent magnetic powder of claim 2 with a bonding agent.

14. A device, wherein the device having the bonded magnet of claim 13.

* * * * *